US005305819A

United States Patent [19]

Boulanger et al.

[11] Patent Number: 5,305,819

[45] Date of Patent: Apr. 26, 1994

[54] GUITAR, AND METHOD OF MANUFACTURING GUITARS

[75] Inventors: Stephen J. Boulanger, La Habra; John F. Page, Anaheim Hills; John W. Black, Corona, all of Calif.

[73] Assignee: Fender Muscial Instruments Corporation, Scottsdale, Ariz.

[21] Appl. No.: 874,303

[22] Filed: Apr. 24, 1992

Related U.S. Application Data

[60] Division of Ser. No. 716,900, Jun. 18, 1991, Pat. No. 5,125,311, which is a continuation-in-part of Ser. No. 642,003, Jan. 16, 1991, abandoned.

[51] Int. Cl.[5] ..... B27F 1/00; G10D 3/00

[52] U.S. Cl. ..... 144/347; 84/291; 29/169.5; 156/293; 156/304.1; 156/304.5; 144/352; 144/353; 144/354; 144/355

[58] Field of Search ..... 29/169.5; 156/293, 299, 156/301, 304.1, 304.5; 84/291, 293; 144/329, 344, 345, 346, 347, 352, 353, 355

[56] References Cited

U.S. PATENT DOCUMENTS

| | | | |
|---|---|---|---|
| 498,113 | 5/1993 | Hartmann . | |
| 2,795,988 | 6/1957 | Maccaferri | 84/293 |
| 2,972,923 | 2/1961 | Fender | 84/313 |
| 3,196,730 | 7/1965 | Daniel | 84/293 |
| 3,204,510 | 9/1965 | Hopf | 84/291 |
| 3,302,507 | 2/1967 | Fender | 84/267 |
| 3,396,621 | 8/1968 | Dycus | 84/293 |
| 3,439,570 | 4/1969 | Lee | 84/293 |
| 3,550,496 | 12/1970 | Fender | 84/293 |
| 3,678,795 | 7/1972 | Fullerton | 84/293 |
| 3,911,778 | 10/1975 | Martin | 84/267 |
| 4,027,570 | 6/1977 | Rendell | 84/293 |
| 4,144,793 | 3/1979 | Soika | 84/291 |
| 4,290,336 | 9/1981 | Peavey | 84/291 |
| 4,334,452 | 6/1982 | Morrison | 84/1.16 |
| 4,432,267 | 2/1984 | Feller | 84/293 |
| 4,456,497 | 6/1984 | Eberle | 156/293 |
| 4,471,012 | 9/1984 | Maxwell | 144/347 |
| 4,538,497 | 9/1985 | Smith | 84/291 |
| 4,557,174 | 12/1985 | Gressett | 84/293 |
| 4,707,204 | 11/1987 | Heeg | 156/293 |
| 4,793,236 | 12/1988 | McGuire | 84/293 |
| 4,803,906 | 2/1989 | Fender | 84/293 |
| 4,896,578 | 1/1990 | Marx | 84/313 |
| 4,905,563 | 3/1990 | Davies | 84/291 |
| 5,029,375 | 7/1991 | Fishman | 29/169.5 |
| 5,114,265 | 5/1992 | Grisley | 144/347 |
| 5,125,312 | 6/1992 | Fishman et al. | 29/169.5 |

FOREIGN PATENT DOCUMENTS

| | | | |
|---|---|---|---|
| 2045993 | 3/1980 | United Kingdom | G10D 1/00 |

OTHER PUBLICATIONS

A drawing showing the neck joint construction of an early Gibson guitar.

*Primary Examiner*—W. Donald Bray
*Attorney, Agent, or Firm*—Richard L. Gausewitz

[57] ABSTRACT

A method by which many identical wooden necks for solid-body electric guitars are manufactured, these being of the conventional type wherein the inner neck ends are connected to the solid bodies by screws. Edge regions of the undersides of at least some of the necks are then routed-out to form a tongue on each routed neck, the tongue extending longitudinally of the neck. Solid wooden bodies are provided for the routed necks, and there are formed in such bodies tongue pockets that correspond generally to the tongues and are shaped to receive them. The tongues are then mounted in the respective tongue pockets and adhesively secured there.

10 Claims, 4 Drawing Sheets

FIG. 2.
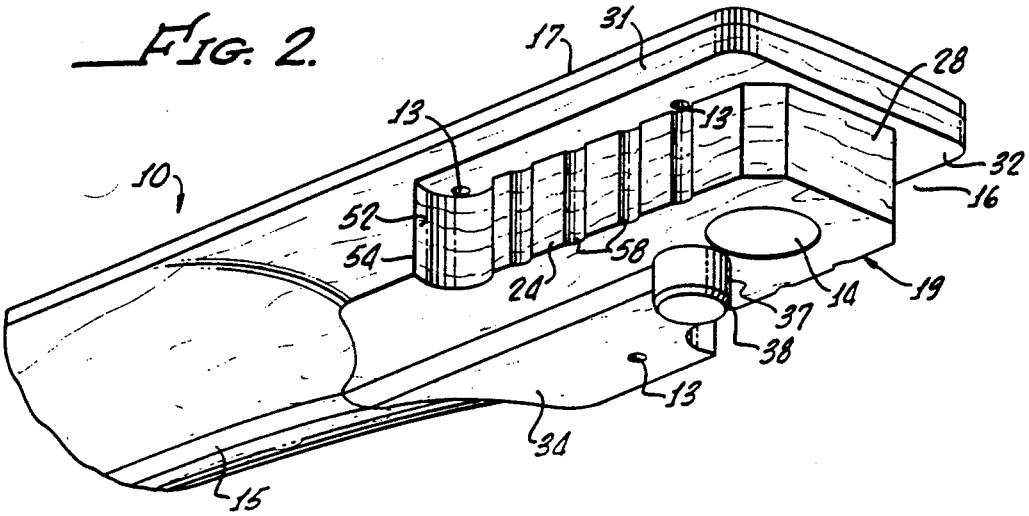
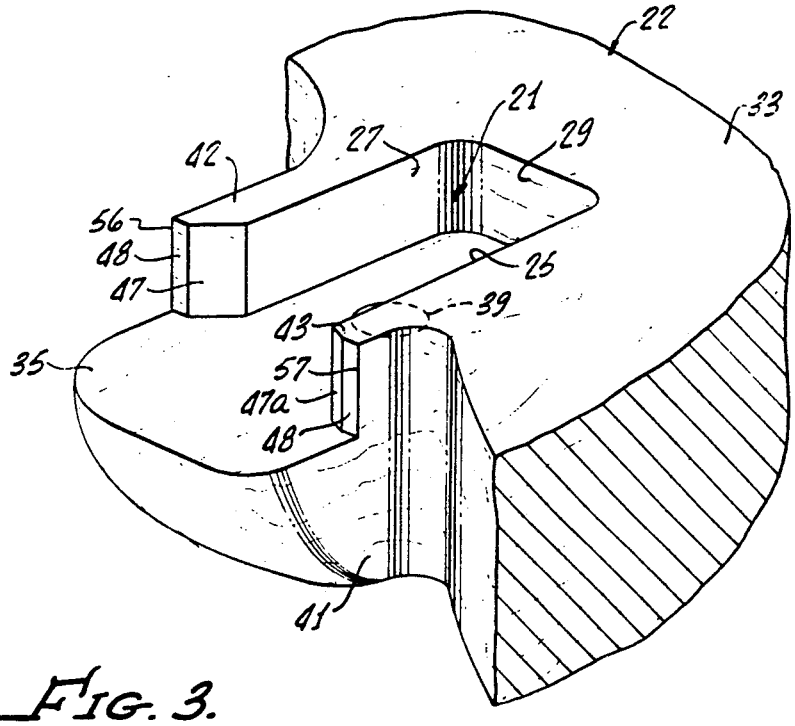
FIG. 3.
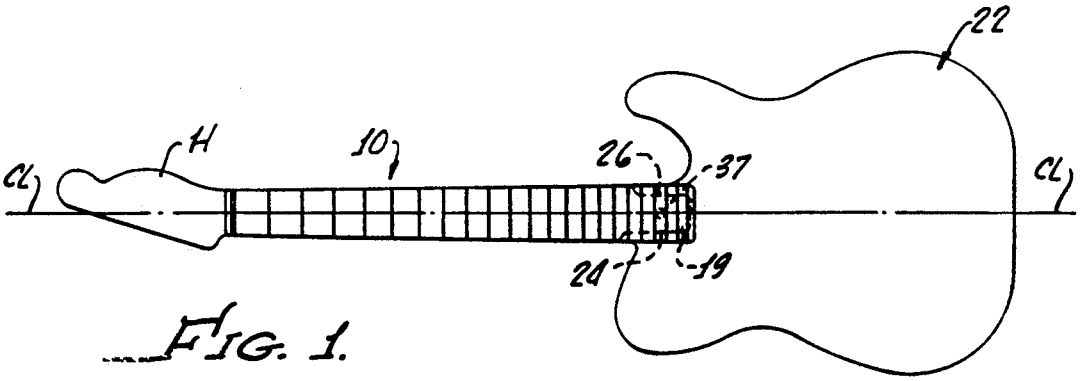
FIG. 1.

GUITAR, AND METHOD OF MANUFACTURING GUITARS

This is a division of application Ser. No. 07/716,900, filed Jun. 18, 1991, U.S. Pat. No. 5,125,311 for Guitar, and Method of Manufacturing Guitars, which is a continuation-in-part of Ser. No. 07/642,003, filed Jan. 16, 1991, and now abandoned, for Guitar, and Method of Manufacturing Guitars.

BACKGROUND OF THE INVENTION

The neck joints of solid-body electric guitars have conventionally been made by screws, although glued joints ("set necks") have also been used. Advantages of the screw-connected neck joints of solid-body electric guitars include economy of production, and ease of alignment of the neck relative to the center line of the guitar body. Relative to the former of these factors, it is emphasized that the economy relates to the joint itself, not to the neck at such. (The neck of an electric guitar is a complex, precision component the proper construction of which is crucial to good guitar playing.) Relative to the latter of the stated factors, if the neck was somewhat out of alignment relative to the body, the screws could be loosened somewhat and the neck slightly shifted in order to achieve the desired alignment.

Screw-connected neck joints of solid-body electric guitars have certain disadvantages. The neck-body connection in a screwed-joint guitar is not as rigid as in a guitar where the joint is permanently made by adhesive. This affects the sustain or dwell of the strings. Another disadvantage is that the protuberance on the guitar body, and which underlies the neck pocket, conventionally has a relatively square-cornered outer end that tends to block the hand of the guitarist when he or she seeks to put his or her fingers on the frets that are relatively close to the bridge. It is desirable to have the body region that underlies the inner end of the neck be rounded and tapered, so that the musician can readily and comfortably move his or her hand close to the bridge.

Another consideration relative to screw-connected necks for solid-body electric guitars is that the joint regions where the necks first reach the protuberances on the bodies, are often not aesthetically pleasing, smooth or beautiful. It is important that continuity of surfaces, absence of cracks, smoothness, etc., be achieved everywhere on each guitar—not excluding the indicated region.

Because of the above-stated disadvantages of screw-connected necks, it is desired by many that the neck joints be made by using adhesive. However, as a practical matter, it is difficult to provide a glued neck joint in a solid-body electric guitar that will reliably, guitar after guitar, cause the center line of the neck to be in precise alignment with the center line of the guitar body. Unlike screw-connected necks, it is not possible to make minor adjustments in neck alignment after the strings are mounted on the guitar. To the contrary, the neck must be properly aligned with the body and permanently secured to it, with assurance that when the strings are eventually mounted they will be exactly where they should be relative to the neck, and vice versa. To state but one example, it would be unsatisfactory if the string adjacent one edge of the neck were closer to such edge than is the string adjacent the other edge of the neck. This would not only look terrible, but would not perform at all satisfactorily, one example being that bending of the strings would be affected.

SUMMARY OF THE INVENTION

One aspect of the present method involves routing out marginal regions of the inner end of a previously-manufactured standard neck for a solid-body guitar to which such neck is conventionally screw connected. The routing is on the underside thereof so as to form a tongue having a certain shape. This tongue has predetermined dimensions and has a width narrower than the width of neck pockets in guitar bodies to which the necks are conventionally screw connected. Such tongue is then inserted into a tongue pocket in a guitar body, such tongue pocket also being narrower than the width of neck pockets in the solid bodies to which the necks are screw connected. The particular shapes of the tongue and its pocket, and the manner of connection of tongue to body, are indicated below and achieve alignment, strength, and beauty in simple and effective ways.

The sides of the tongue converge gradually, in a direction away from the head end of the neck. Stated more definitely, one such side converges gradually toward the other, such other side being parallel to the center line of the neck. The sides of the tongue pocket in the body are correspondingly configured, one side converging toward the other that is parallel to the center line of the body. The tongue is glued to surfaces of the tongue pocket while the described sides are in close flatwise engagement with each other, to achieve a strong glued joint and to achieve correct permanent alignment of the center line of the neck with the center line of the body.

In accordance with another aspect of the method and apparatus, the close abutment is achieved by a camming action, using a pin that extends into the tongue and into the body. The pin and the bore therefor are so constructed that forcing of the pin into the bore causes very tight pressing of the tongue into the tongue pocket, and maintains the tongue thus pressed in the tongue pocket while the glue is drying and thereafter. Only one clamp is employed in the manufacturing operation, this being the clamp that holds down the butt end of the neck; there is no need for a clamp to apply pressure longitudinally of the neck.

In accordance with another aspect of the apparatus and method, sharp edges are formed where side edges of the neck meet end regions of a protuberance on the solid body. These sharp edges are so located and constructed that they are compressed or crushed in response to the last portion of the forcing of the tongue into the tongue pocket. This creates very smooth junction regions characterized by the absence of gaps and imperfections. The described crushing makes a "fine line" joint possible. The outerbottom portion of the protuberance on the body is rounded to facilitate reaching of the frets nearest the bridge, and for aesthetic reasons.

Grooves of divots are spaced around the abutting tongue and pocket surfaces, to allow glue to migrate during clamping. This effectively distributes glue in an even manner, while still maintaining wood-to-wood contact for excellent energy transfer between neck and body.

BRIEF DESCRIPTION OF THE DRAWINGS

FIG. 1 is a top plane view of a guitar body and guitar neck assembled with each other in accordance with the present invention;

FIG. 2 is an isometric view, as viewed from below, of the inner end of a guitar neck incorporating the present invention, but with the frets unshown;

FIG. 3 is an isometric view, as viewed from above, of the pocket region of a guitar body, adapted to receive the tongue shown in FIG. 2;

DETAILED DESCRIPTION OF THE PREFERRED EMBODIMENT

The present apparatus and method may be employed relative to numerous types of guitars by numerous manufacturers. It is here described as employed relative to a solid body electric guitar, one early example of which is shown in U.S. Pat. No. 2,972,923, issued Feb. 28, 1961, inventor C. L. Fender. The greatly preferred neck is shown and described in U.S. Pat. No. 4,557,174, issued Dec. 10, 1985, inventor C. A. Gressett, Jr. Both of said patents are hereby incorporated by reference herein.

The present invention is applicable to both standard (treble) guitars and base guitars; the word "guitar" applies to both in this specification and claims.

Figure 7:
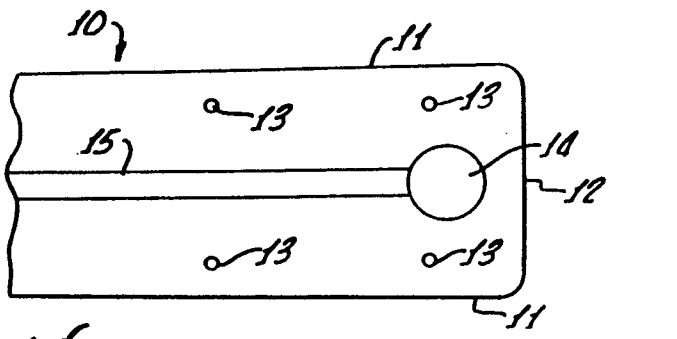
FIG. 7. (PRIOR ART)
FIG. 7 is a bottom plan view of the inner end of a neck adapted to be connected by screws to a guitar body.

Referring first to FIG. 7 of the present application, this is the inner end of a neck 10 manufactured in accordance with the U.S. Pat. No. 4,557,174. As shown, the neck end has vertical sidewalls 11 and an end wall 12, disposed at substantially right angles to each other. As is standard in the art, this inner end is mounted in a neck pocket formed in the solid body of the guitar being manufactured. The dimensions of the neck pocket are such that the neck pocket receives, relatively snugly, the illustrated inner end. As shown, the inner neck end has screw holes 13 adapted to receive the screws which secure the inner neck end to the solid body. Also shown in FIG. 7 is the bottom end of the retaining nut 14 that connects to the truss rod in the neck and prevents such truss rod from rotating and also prevents the truss rod end from moving longitudinally (the retaining nut is shown and described relative to number 31 in the cited U.S. Pat. No. 4,557,174). Also shown in FIG. 7 is the "skunk stripe" 15 that conceals the truss rod (such skunk stripe being a strip of wood described relative to number 48 in the cited U.S. Pat. No. 4,557,174).

A batch of guitar necks that are largely completely manufactured, but normally except for finishing, etc., for mounting on solid bodies by means of screws (for example, necks shown and described in U.S. Pat. No. 4,557,174 and relative to FIG. 7 of the present application) are further manufactured in simple and economical ways for effective mounting on guitar bodies by gluing. The necks are identical, whether secured by screws or by gluing, the only differences preferably being those described below.

Figure 4:
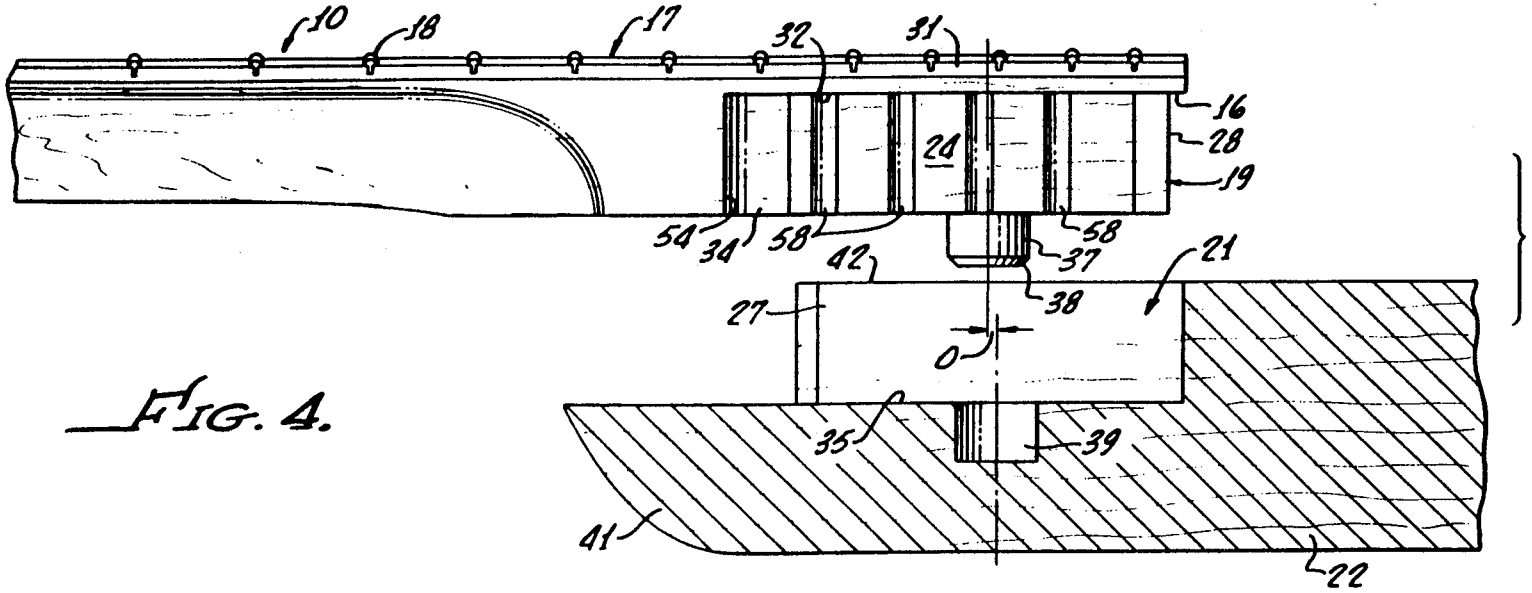
FIG. 4 is a view, partially in vertical section and partially in side elevation showing the neck end of FIG. 2 as related to the guitar body portion of FIG. 3.
Figure 5:
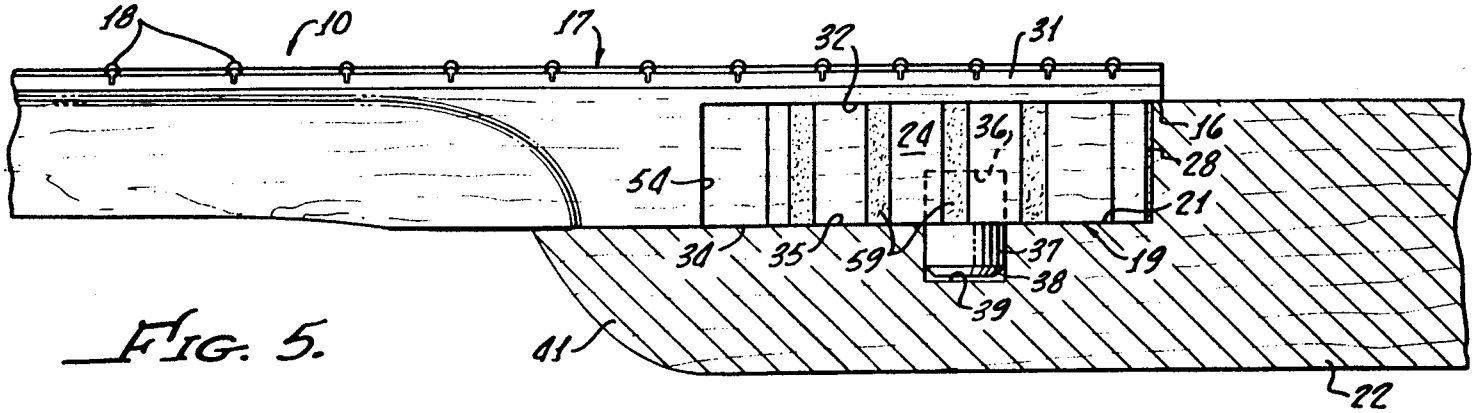
FIG. 5 corresponds to FIG. 4 but shows the parts in assembled positions.

To adapt any number of complete (except for finishing, etc.) previously-manufactured necks for adhesive connection to guitar bodies, two additional steps are performed relative to each neck. The first such additional step is to rout out marginal regions of the lower portion of the inner neck end to form indented side and end regions 16 of precisely predetermined configuration (FIG. 2). Very preferably, the routing is done to remove wood from the main body of the neck 10, not from the fretboard 17 which is adhesively secured to the upper surface of the main neck body and incorporates the frets 18 of the neck (FIGS. 4 and 5). The routing forms a tongue 19 at the inner neck end, the tongue having a special shape and being adapted to fit into a tongue-receiving groove or pocket 21 (FIG. 3) of the solid guitar body 22.

Both the tongue 19 and its pocket 21 extend longitudinally of the body and neck of the guitar. The pocket 21 is adapted to snugly receive the tongue 19, in glued relationship such that the neck and body are correctly aligned, as described below.

Figure 6:
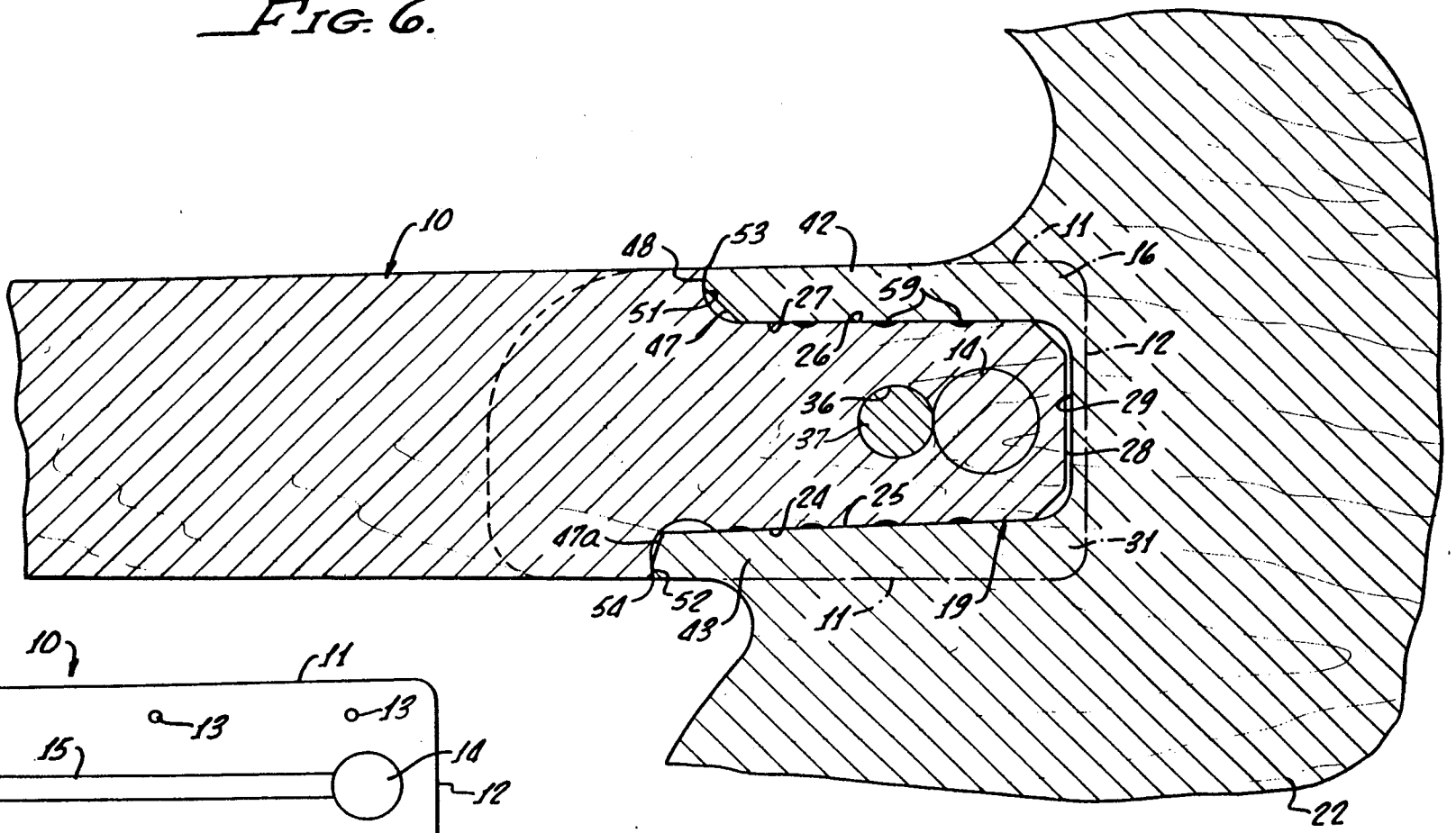
FIG. 6 is a horizontal sectional view, looking downwardly, of the assembled components of FIG. 5, the truss rod being unshown.

Thus, tongue 19 has a planar vertical side 24 (FIG. 2) adapted to be in flatwise engagement with a planar vertical side 25 (FIGS. 3 and 6) of tongue pocket 21. On its other longitudinal side, tongue 19 has a planar vertical side 26 (FIG. 6) adapted to be in flatwise engagement with a planar vertical side 27 of pocket 21 (FIGS. 3 and 6). The end 28 of the tongue preferably does not engage the end 29 of pocket 21, even when the parts are fully assembled as shown in FIG. 6.

Because of the above-described routing of neck material, to form the indented side and end regions 16, the neck end has a peripheral ledge 31 at its sides and end. Preferably, the ledge is composed of the body of the neck and the end of fretboard 17. The routing is so performed that the underside 32 of ledge 31 is flat, being parallel to and adapted to flatwise engage the upper surface 33 of body 22 (FIG. 5). The routing is also such that, at the same time that surfaces 32,33 come into flatwise engagement, the bottom surface 34 of tongue 19 (and adjacent regions) comes into flatwise engagement with the bottom surface 35 of pocket 21 (and adjacent regions).

It is pointed out that the side and end walls of ledge 31 are what remain of the side and end walls 11,12 (FIG. 7) of the neck as originally formed. Thus, these side and end walls are indicated in phantom line in FIG. 6.

Further Description of Method and Apparatus for Creating a High-Quality Strong, Aligned, Glued Joint Sidewalls 24,26 of tongue 19 are oriented in wedge relationship to each other, in that there is convergence in a direction away from the head end of the guitar neck. Sidewalls 25,27 of pocket 21 are correspondingly wedge related, being adapted to be engaged simultaneously by the respective sides 24,26 in flatwise relationships as the neck 10 is moved longitudinally toward the bridge region of the guitar body. It is possible to make the wedging action terminate by engagement of surfaces 28,29 with each other, but this is not preferred. A greatly better way of terminating the wedging action includes performing the above-indicated second manufacturing step relative to the otherwise completed (except for finishing) neck the inner end of which is shown in FIG. 7.

This second manufacturing operation comprises drilling a hole 36 (FIG. 6) perpendicular to the bottom surface 34 of the neck end and generally in the center thereof, the hole being preferably adjacent retaining nut 14. The hole 36 is, in part, through the skunk stripe 15, the presently-preferred hole diameter being one-half inch. Into the hole 36 (FIG. 6) is snugly inserted, and preferably glued, a combination bearing and cam pin 37 preferably formed of steel. A satisfactory depth of hole 36 is approximately ⅜ inch, into which the pin 37 is inserted to full depth. Pin 37 extends out of hole 36 for preferably about the same distance.

As shown in FIGS. 2, 4 and 5, there is a cam edge or bevel 38 at the outer end of pin 37.

Referring to FIG. 4, there is shown a bore 39 in body 22, adapted to receive snugly the cam and bearing pin 37. In accordance with one aspect of the present invention, the center of pin 37 is not aligned with the center of bore 39 when the tongue 19 has been pushed into pocket 21 as far as it will go in response to reasonable longitudinal pressure exerted manually. Thus, the offset indicated at "O" in FIG. 4 is present between the centers of the pin and the associated bore 39 in the body. (It is to be understood that the showing of FIG. 4 illustrates the neck completely above the body, this being for purposes of clarity of illustration.)

The amount of offset O is empirically determined, being typically about 0.010–0.015 inch. The width of each side of the bevel or cam edge 38 is equal to or greater than the amount of offset O. The empirical considerations which determine the amount of offset include the type of wood, and the desired amount of "crushing" of edges described below. There is achieved very tight flatwise engagement of the wedge-related surfaces, plus edge crushing subsequently described.

When tongue 19 has been longitudinally inserted manually as far as it will go with reasonable manual pressure, with the bottom end of pin 37 resting on surface 35, the neck end is actuated downwardly to create a cam action between cam or bevel edge 38 and the left side (FIGS. 4 and 5) of bore 39. This cam action forces the wedging surface into much tighter engagement in that the neck end is shifted to the right (FIGS. 4 and 5) the additional distance determined by offset O.

The cooperation between the pin 37, the bore walls for the upper and lower portions of the pin, and the wedge surfaces is such that tongue 19 is very tightly engaged with wedge surface means as described below. Only one clamp need be employed while the glue dries, this clamp being a C-clamp that presses down against the upper surface of the neck end and presses up against the lower surface of the guitar body region below pocket 21. No longitudinal clamping action is required.

In accordance with the best mode contemplated by the inventors, the C-clamp presses the neck end downwardly, for the full distance of downward neck movement, to cause the described cam action and then hold the parts tightly together while the glue dries.

In accordance with another aspect of the present invention, the described wedging action is not created by symmetrical wedging surfaces but instead by asymmetrical surfaces one of which is parallel to the center line of neck 10 or body 22. In the illustrated embodiment, surfaces 26 and 27 are accurately parallel to the center line "CL" (FIG. 1) of the guitar body and the neck, respectively. Surfaces 24,25, on the other hand, converge toward the neck or body center line in the direction away from the head H of the guitar (FIG. 1). The angle of such convergence is not great, being preferably about two degrees.

Prior to the assembly into the condition shown in FIG. 1, surface 26 is parallel to the neck center line, and surface 27 to the body center line. After assembly, the neck and body center lines become substantially coincident as shown at CL in FIG. 1.

Because guitar necks and bodies are made primarily of wood, and because wood often has variations, sanding is often performed to create a perfect fit between tongue 19 and the walls of tongue pocket 21. In the present guitar, such sanding is done substantially entirely on the inclined surface or side 24 of the tongue, and on pocket side 25, not on the straight (not converging) side 26 of the tongue or on the straight side 27 of the body. The straight sides 26,27 remain as reference surfaces which operate accurately to maintain the neck 10 in substantially perfect alignment with the center line CL (FIG. 1).

It is emphasized that even a slight amount of inclination of the neck relative to the center line is unsatisfactory, one reason being because the guitar strings would not be perfectly positioned relative to the fretboard 17. The neck 10 is so long that a fraction of a degree of inclination creates a seriously adverse problem and, typically, rejection.

Structure Permitting Practical Formation of a Joint Having Excellent Aesthetics The solid body 22 has a protuberance 41 at the outer end of the pocket 21. As shown in FIG. 3, part of the pocket 21 is in the main body 22 while another part of the pocket 21 is between walls 42,43 that are integral with the main body and that extend away from the center thereof—being generally parallel to pocket sides 25,27. The protuberance 41 is beneath at least the outer regions of walls 42,43, and also extends substantially further away from the center of the body (namely, toward the neck end of the guitar). The upper surface of protuberance 41 is the same as the bottom surface 35 of pocket 21, forming an extension of such bottom surface.

As shown in FIGS. 3 and 6, wall 43 extends farther toward head H than does wall 42. Furthermore, the tongue side 24 that tapers is longer than is the tongue side 26 that is parallel to center line CL (FIG. 1).

To improve greatly the aesthetics of the joints between the outer ends of walls 42,43, and the neck side regions immediately adjacent such outer ends, these adjacent elements are formed in special ways and caused to tightly contact each other in response to the above-described cam action created by bearing and cam pin 37.

Each wall 42,43 has a beveled corner surface **47,47*a* that facilitates entry of tongue 19 into pocket 21, and also has a square end surface 48** lying in one of two parallel planes that are each perpendicular to the center line CL.

The forward ends of the indented side and end region 16 of the neck are walls 51,52 that, at least at their portions adjacent the side walls of the neck, incline back toward the guitar body. Thus, very preferably, they are not in a plane perpendicular to the center line. Stated more definitely, and referring to FIG. 6, wall 51 extends outwardly and to the right relative to a plane (not shown) that is perpendicular to the center line on the neck. Similarly, wall 52 also extends outwardly and to the right relative to a plane perpendicular to such center line. The preferred angle of inclination, at regions adjacent the sides of the neck, is about two degrees.

Sharp corners 53,54 (FIG. 6) are formed on the sides of the neck, each corner being at the outer neck surface and at the end of the routed-out region 16. Corners 56,57 are formed on the body 22, as shown in FIG. 3, at the outer edges of end surfaces 48. The outer sides of walls 42,43 are flush with the outer sides of the guitar neck adjacent thereto, being coplanar therewith.

Thus, when tongue 19 is inserted substantially fully into pocket 21, the sharp edges 56 (FIG. 3) and 53 (FIG. 6) on one side of the guitar engage each other, and the sharp edges 57 (FIG. 3) and 54 (FIGS. 2 and 6) engage each other.

It is emphasized that the surface 52 (FIG. 2) is very preferably not at a right angle to the adjacent unrouted outer surface region of the guitar, being instead at an angle of (preferably) about eighty-eight degrees thereto. This is the result of the above-described inclination toward the main body of the end walls of the routed regions. The same is true on the other side of the guitar, wall 51 being at an angle of preferably eighty-eight degrees to the adjacent outer unrouted surface regions of the guitar neck.

When pin 37 is forced into bore 39, the corners 53,54 become crushed tightly against corners 56,57. This creates fine lines that extend vertically and that are visible when looking at opposite sides of the joint at the ends of walls 42,43. When the adjacent regions of the neck and walls 42,43 are sanded, these lines to not disappear (form holes) because, preferably, the taper of end walls 51,52 is only a few degrees (such as the exemplary two degrees stated above).

It is pointed out that the walls 42 have thicknesses and configurations that (except at bevelled surfaces 47,47*a*) correspond generally to the shape of the routed-out or indented side and end regions 16 of the neck. When the neck is fully mounted on the body, the exterior surfaces are flush and smooth; discrepancies such as at walls 47 and at the end of the tongue are not visible.

SUMMARY OF THE METHOD

Many necks are manufactured in accordance with U.S. Pat. No. 4,557,174. Many solid bodies are made in conventional manner, with neck-receiving pockets each adapted to receive the neck end shown in FIG. 7, which neck end is secured thereto by screws. Many other bodies are made as described in the present application, for example relative to FIG. 3. Except for the changed regions shown in FIG. 3, the last-mentioned bodies are identical to conventional solid bodies (to which necks are screw connected in conventional manner).

To produce solid-body guitars having glued on necks, the manufactured necks are subjected to two additional steps. The first is the formation of the routed-out indented side and end regions 16 described in detail above. The second is providing the combination bearing and cam pin 37 in a bore 36 therefor.

The tongue 19 is lightly sanded on the parallel side 26—parallel to its center line—to remove any imperfections and "fuzz". The side 27 of tongue pocket 21 is also thus lightly sanded.

The tapered side 24 of the tongue 19, and the associated tapered side 25 of pocket 21, are sanded (with a flat sander) to whatever extent is needed to cause the tongue 19 to fit correctly in the pocket 21. Sanding is not always needed. "Correctly" means, as described in detail above, to such an extent that the tongue 19 may be manually introduced into pocket 21 just until there is the above-indicated offset O (FIG. 4).

If the tongue is insertable too far into its pocket, glue-absorbing shims are provided flatwise on the surface 24 or 25.

Wood glue is applied to all surfaces that are to be adjacent each other, both on the neck and the body. After the glue is applied, the tongue 19 moved about half way into the pocket 21, without contacting the body, and then is moved downwardly until the bottom surface of pin 37 rests on surface 35. Then, the neck is moved longitudinally inwardly until the neck is seated in the pocket—except that the bottom surface 34 is spaced above surface 35 by the length of the protruding portion of pin 37.

Then, the above-described operation by which pin 37 is pressed into bore 39 is performed, which shifts the neck further to the right by the offset distance O (FIG. 4) and holds it there during the time the glue dries. The pin 37 also cooperates with the glue, after drying of the glue, in the maintaining of a very strong joint. The C-clamp is employed to press down the upper surface of the fretboard and to press up on the bottom surface of the body; no other clamp is required.

During the described operation, the glue (adhesive) migrates and extrudes, and some permeates the pores in the wood. There is wood-to-wood contact between surfaces 24,25; 26,27; 32,33; and 34,35.

To prevent hydraulic action and assure that there is wood-to-wood contact, vertical grooves or "divots" are provided in the tongue in spaced relationship, as indicated at 58. The glue is shown in the divots in FIGS. 5 and 6, being indicated by the reference numeral 59. It is to be understood that some other glue, not shown, is present near the inner end of the tongue, in the cavities adjacent surfaces 47 and 47*a*, etc.

The preferred adhesive is cabinet glue, called yellow glue, which is aliphatic resin.

The above-described "crushing" action creates the fine-line joints at edges 53,56,54,57, as described in detail in the preceding section. These are sanded, and because of the stated angle the sanding is not harmful.

Figure 8:
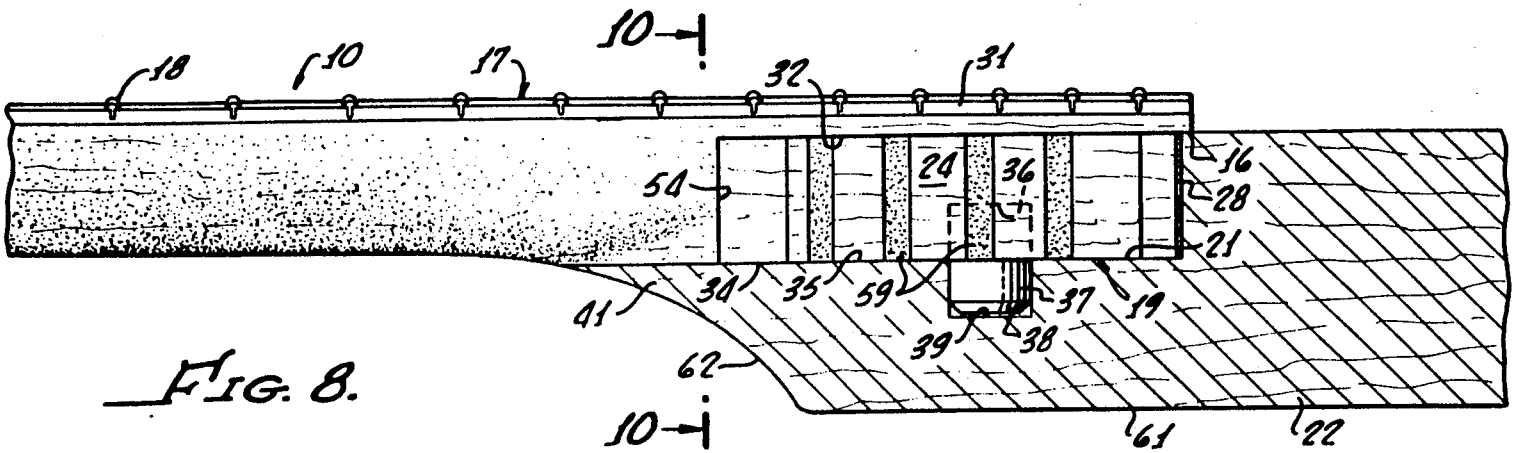
FIG. 8 is a view corresponding to FIG. 6 but showing the configuration after regions of the guitar body and guitar neck, at the joint therebetween, have been carved.
Figure 9:
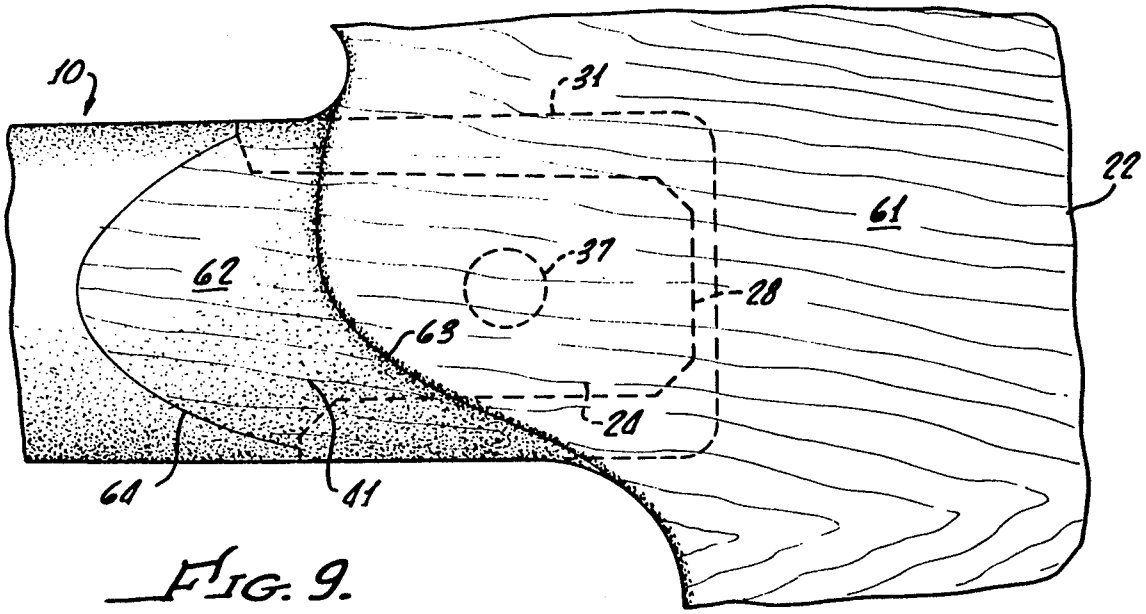
FIG. 9 is a bottom plan view of the right and central regions of the showing of FIG. 8.
Figure 10:
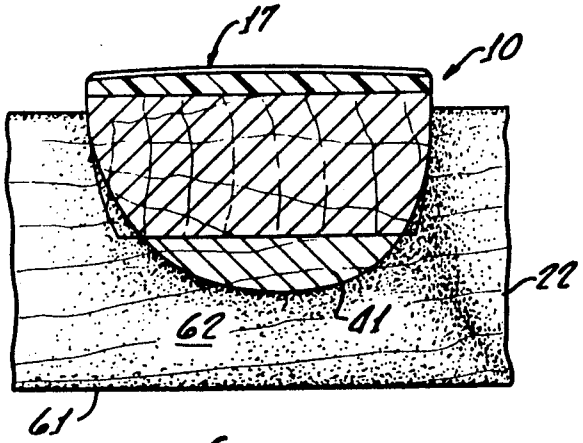
FIG. 10 is a sectional view on line 10—10 of FIG. 8, the truss rod means being unshown.

After the glue has set, the protuberance 41 is carved back in order to achieve the end configuration shown in FIGS. 8–10. The neck is also carved at the region adjacent the body, to achieve the smooth curved configuration shown in FIG. 10.

To state the above more fully, the bottom of guitar body 22 has a planar surface 61. After the glue has set in the joint, a large part of the protuberance 41 is carved off to form the rounded concave-convex surface shown at 62 in FIGS. 8–10. Surface 62 meets the planar bottom 61 of body 62 at curved line 63 (FIG. 9). The joint line between surface 62 and neck 10 is the curved line 64 (FIG. 9).

As above indicated, the carving includes regions of neck 10 relatively adjacent the body. The result is a continuous and seemingly "integral" look at the joint between neck and body. Furthermore, and very importantly, the relationships are such that the guitarist may reach frets that are very close to the bridge. Because of the very substantial carving back of protuberance 41, the left hand of the guitarist is able to move up the neck until it is relatively close to the bridge. This carving back cannot be done in a guitar whose neck is mounted by screws, because the joint would not be strong.

The guitar is then finished and provided with hardware, etc.

It is to be understood that in some guitars the center line of the body is not the same as the center line of the bridge. In such guitars, the center line of the bridge is what is referred to by "center line of the body".

The foregoing detailed description is to be clearly understood as given by way of illustration and example only, the spirit and scope of this invention being limited solely by the appended claims.

What is claimed is:

1. A method of mass producing set-neck solid body electric guitars, which comprises:

(a) manufacturing many identical wooden necks for solid-body electric guitars of the conventional type wherein the inner neck ends are connected to solid bodies by screws, (b) routing-out edge regions of the undersides of at least some of said necks to thus form a tongue on each routed neck, the tongue extending longitudinally of the neck, (c) providing solid wooden bodies for said routed necks, and forming tongue pockets in said bodies corresponding generally to said tongues and adapted to receive the same, and (d) tightly mounting said tongues in said respective tongue pockets and adhesively securing them there.

2. The invention as claimed in claim 1, in which said method further comprises providing protuberances integrally on said respective bodies and extending outwardly therefrom, providing said tongue pockets partly in said protuberances, and causing said protuberances to have outer sides flush with the outer edges of the upper sides of said necks.

3. A method of manufacturing a guitar, which comprises:

(a) providing an elongate wooden neck, (b) providing a wooden body, (c) providing a pocket in said body extending to one edge portion thereof, said pocket being sized to receive an inner end portion of said neck, (d) causing one flat sidewall of said pocket to be parallel to the center line of said guitar body, (e) causing the corresponding flat sidewall of the inner end portion of said neck to be parallel to the center line of said neck, (f) creating a wedging action between the flat sidewalls of said pocket and the flat sidewalls of said inner end portion of said neck, said wedging action being such that longitudinal movement of said neck toward the center of said body creates strong wedge gripping of the flat sidewalls of said inner end of said neck by the flat sidewalls of said pocket, and causes said parallel sidewalls to be in tight flatwise abutment, and (g) locking said inner end of said neck in said pocket.

4. The invention as claimed in claim 3, in which said method further comprises sandpapering the sidewalls of said neck and pocket other than said parallel sidewalls thereof, to fit the parts together, said parallel sidewalls then remaining as substantially unsanded reference surfaces, and effecting said locking by means including adhesive.

5. A method of forming a joint between a guitar neck and a guitar body, comprising:

(a) providing a wooden guitar body having a neck pocket therein, said pocket having side surfaces, (b) providing an elongate wooden neck having side surfaces at the inner end portion thereof, (c) causing said side surfaces of said neck end portion to interrelate with said side surfaces of said body in wedge relationship such that the degree of wedging increases in response to pressing of said inner neck end portion into said pocket, (d) providing a bearing and cam pin in said neck end portion in such position that the outer end of said bearing and cam pin engages the bottom wall of said pocket, (e) providing a bore for said pin, in said bottom wall, centered slightly inwardly of the position of the center of said pin end when said wedged side surfaces are pushed together with manual pressure applied longitudinal to said neck, (f) forcing said pin into said bore, by moving said neck end portion downwardly against the bottom of said pocket, to increase the wedging contact, and (g) gluing said neck end portion in said pocket.

6. The invention as claimed in claim 5, in which the outer end portion of said pin is bevelled.

7. The invention as claimed in claim 5, in which said pin center and bore center are about 0.010–0.015 inch offset prior to said forcing step.

8. A method of creating an externally smooth joint between a solid wooden guitar body and an elongate guitar neck, said method comprising, (a) providing a tongue pocket in the top of a guitar body, said tongue pocket being defined in part by wall means having end surfaces, (b) providing a routed-out indented region at the lower part of the inner end of a guitar neck, to form a tongue adapted to seat in said tongue pocket, and in such relationship that the ends of said routed-out indented region have sharp edges adapted to engage said end surfaces and to be crushed into close line contact therewith, (c) forcing said sharp edges against said surfaces to crush said edges, and (d) maintaining said sharp edges crushed against said surfaces.

9. The invention as claimed in claim 8, in which said forcing is achieved by pressing a combination cam and bearing pin, on said neck end portion, into an offset bore in said body pocket.

10. The invention as claimed in claim 8, in which said body pocket is partially in a protuberance on said body, the sides of said protuberance and neck being flush, said sharp edges being at junctions between said sides.

* * * * *